US007100865B2

(12) United States Patent
Byrne et al.

(10) Patent No.: US 7,100,865 B2
(45) Date of Patent: Sep. 5, 2006

(54) METHOD AND APPARATUS FOR STOWING AND DEPLOYING CONTROL SURFACES OF A GUIDED AIR VEHICLE

(75) Inventors: James Patrick Byrne, Hudson, OH (US); Andrew Thompson, Grand Rapids, MI (US)

(73) Assignee: Simmonds Precision Products, Inc., Vergennes, VT (US)

( * ) Notice: Subject to any disclaimer, the term of this patent is extended or adjusted under 35 U.S.C. 154(b) by 220 days.

(21) Appl. No.: 10/720,400

(22) Filed: Nov. 24, 2003

(65) Prior Publication Data

US 2005/0109873 A1 May 26, 2005

(51) Int. Cl.
*F42B 13/32* (2006.01)

(52) U.S. Cl. ..... 244/3.28; 244/49

(58) Field of Classification Search ..... 244/3.24–3.3, 244/49, 91

See application file for complete search history.

(56) References Cited

U.S. PATENT DOCUMENTS 2,405,415 A * 8/1946 Eksergian ..... 244/3.23
3,754,726 A * 8/1973 Rusbach ..... 244/3.28
3,790,104 A * 2/1974 Jones ..... 244/3.27
6,073,880 A * 6/2000 Voigt et al. ..... 244/3.28
6,588,700 B1 * 7/2003 Moore et al. ..... 244/3.28
6,695,252 B1 * 2/2004 Dryer ..... 244/3.28

* cited by examiner

*Primary Examiner*—Galen Barefoot
(74) *Attorney, Agent, or Firm*—Peter Hernandez, Esq.; Calfee, Halter & Griswold LLP

(57) ABSTRACT

Apparatus for stowing and deploying a plurality of control surfaces of a guided air vehicle comprises: a housing including: a plurality of slotted openings along an outside surface thereof; and a corresponding plurality of cavities within the housing, each cavity extending to the outside surface of the housing through the slotted opening corresponding thereto and configured to accommodate span wise stowage of a corresponding control surface of the plurality, and each cavity having a section including an angled ledge and side wall support surface to accommodate stowage of the corresponding control surface in a span wise canted position with respect to the corresponding slotted opening. A method of operating comprises the steps of: folding each control surface of the plurality edge wise through the corresponding slotted opening and into the corresponding cavity within the housing; moving each folded control surface into a stowage section of the corresponding cavity to edge wise mis-align each folded control surface from the corresponding slotted opening; moving each control surface in the corresponding cavity from the corresponding stowage section into edge wise alignment with the corresponding slotted opening; and deploying each control surface edge wise aligned with the corresponding slotted opening from the cavity through the corresponding slotted opening to a deployed position.

20 Claims, 7 Drawing Sheets

METHOD AND APPARATUS FOR STOWING AND DEPLOYING CONTROL SURFACES OF A GUIDED AIR VEHICLE

BACKGROUND OF THE INVENTION

The present invention relates to guided air vehicles with control surfaces, in general, and more particularly, to method and apparatus for stowing and deploying the control surfaces of the guided air vehicle.

Guided air vehicles such as missiles, smart bombs, smart munitions, projectiles and bullets, for example, utilize control surfaces, such as fins, canards and wings, for example, to guide their trajectory along a desired flight path. Such air vehicles, especially those launched from manned or unmanned aircraft or ground craft, require that their control surfaces be stowed within or partially within the body of the air vehicle during storage and transportation, and also during launch in order to: (1) minimize potential damage; (2) allow the air vehicle to fit physically in the launch apparatus; and (3) minimize the effects of aerodynamic forces acting upon the control surfaces during launch. Once the air vehicle is in flight, the control surfaces may be deployed to their desired positions for guiding the vehicle. In many instances, control surface deployment is controlled by an on-board processor to allow completion of the air vehicle mission in accordance with a desired target strategy.

Many different apparatus have been developed for stowing and deploying the control surfaces of an air vehicle including: electromechanical, solenoids, pyrotechnic gas generators and retractors, and mechanical apparatus such as no-backs and inefficient transmissions, for example. Depending upon the circumstances and operating environments, some apparatus were found to be inappropriate for the given task; others were found not to work; and still others were found to be too expensive to implement. In addition, deployment apparatus using pyrotechnic devices or other similar devices have significant drawbacks of: not being indestructibly testable since they operate on a single shot basis, and of inducing significant shock to the supporting structure.

Accordingly, there is a need for method and apparatus for stowing and deploying control surfaces of a guided air vehicle that overcome the drawbacks and limitations of the conventional apparatus and are simpler and more cost effective. The present invention is intended to provide such apparatus and method that satisfy these needs.

SUMMARY OF THE INVENTION

In accordance with one aspect of the present invention, apparatus for stowing and deploying a plurality of control surfaces of a guided air vehicle comprises: a housing including: a plurality of slotted openings along an outside surface thereof; and a corresponding plurality of cavities within the housing, each cavity extending to the outside surface of the housing through the slotted opening corresponding thereto and configured to accommodate span wise stowage of a corresponding control surface of the plurality, and each cavity having a section including an angled ledge and side wall support surface to accommodate stowage of the corresponding control surface in a span wise canted position with respect to the corresponding slotted opening.

In accordance with another aspect of the present invention, a method of stowing and deploying a plurality of control surfaces of a guided air vehicle comprises the steps of: folding each control surface of the plurality edge wise through a corresponding slotted opening disposed along an outside surface of a housing and into a corresponding cavity within the housing; moving each folded control surface into a stowage section of the corresponding cavity to edge wise mis-align each folded control surface from the corresponding slotted opening; moving each control surface in the corresponding cavity from the corresponding stowage section into edge wise alignment with the corresponding slotted opening; and deploying each control surface edge wise aligned with the corresponding slotted opening from the cavity through the corresponding slotted opening to a deployed position.

DETAILED DESCRIPTION OF THE INVENTION

Figure 1A:
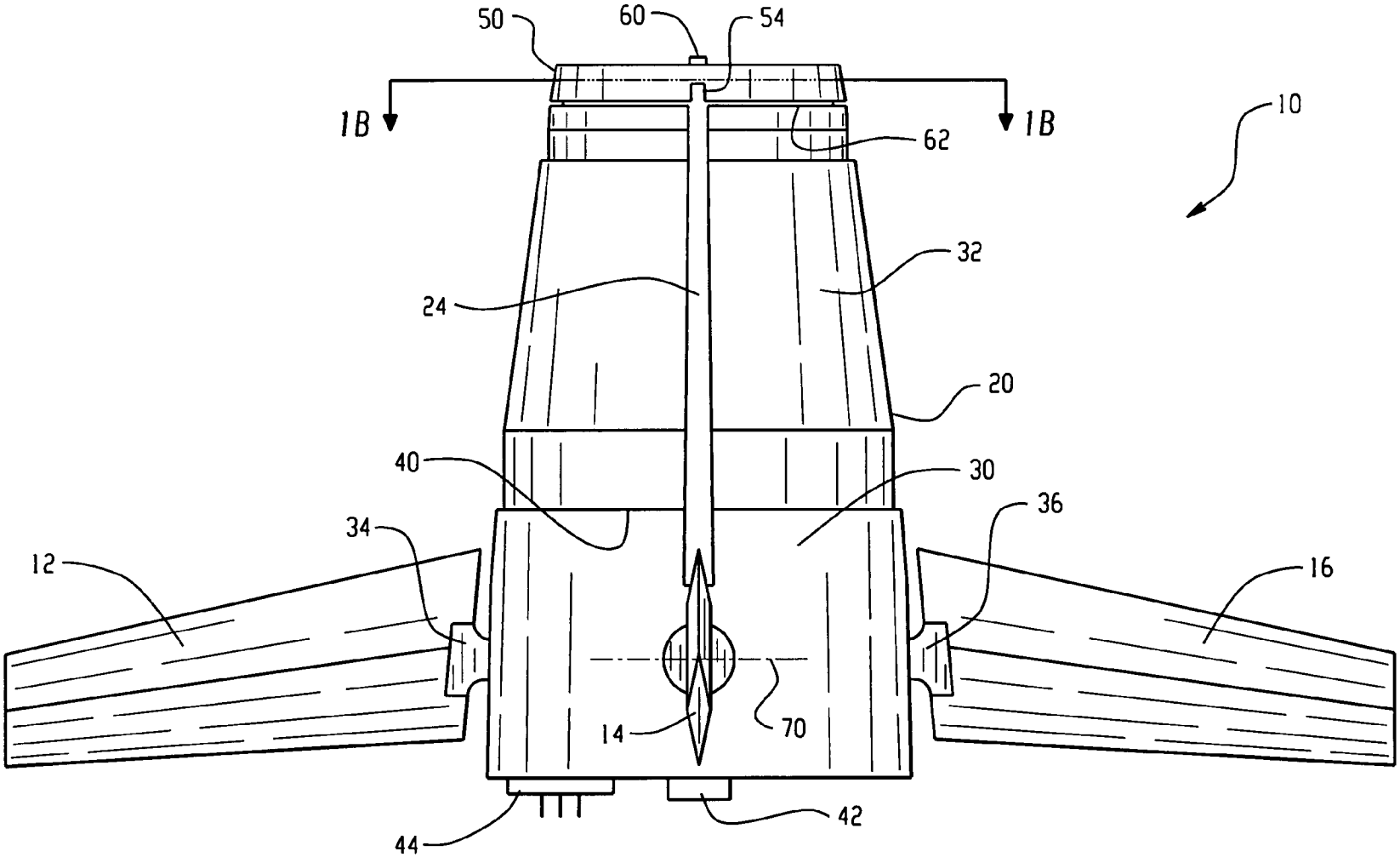
FIGS. 1A and 1B are side and sectional top views, respectively, of a control unit containing a plurality of control surfaces shown in a deployed state suitable for embodying the broad principles of the present invention.
Figure 1B:
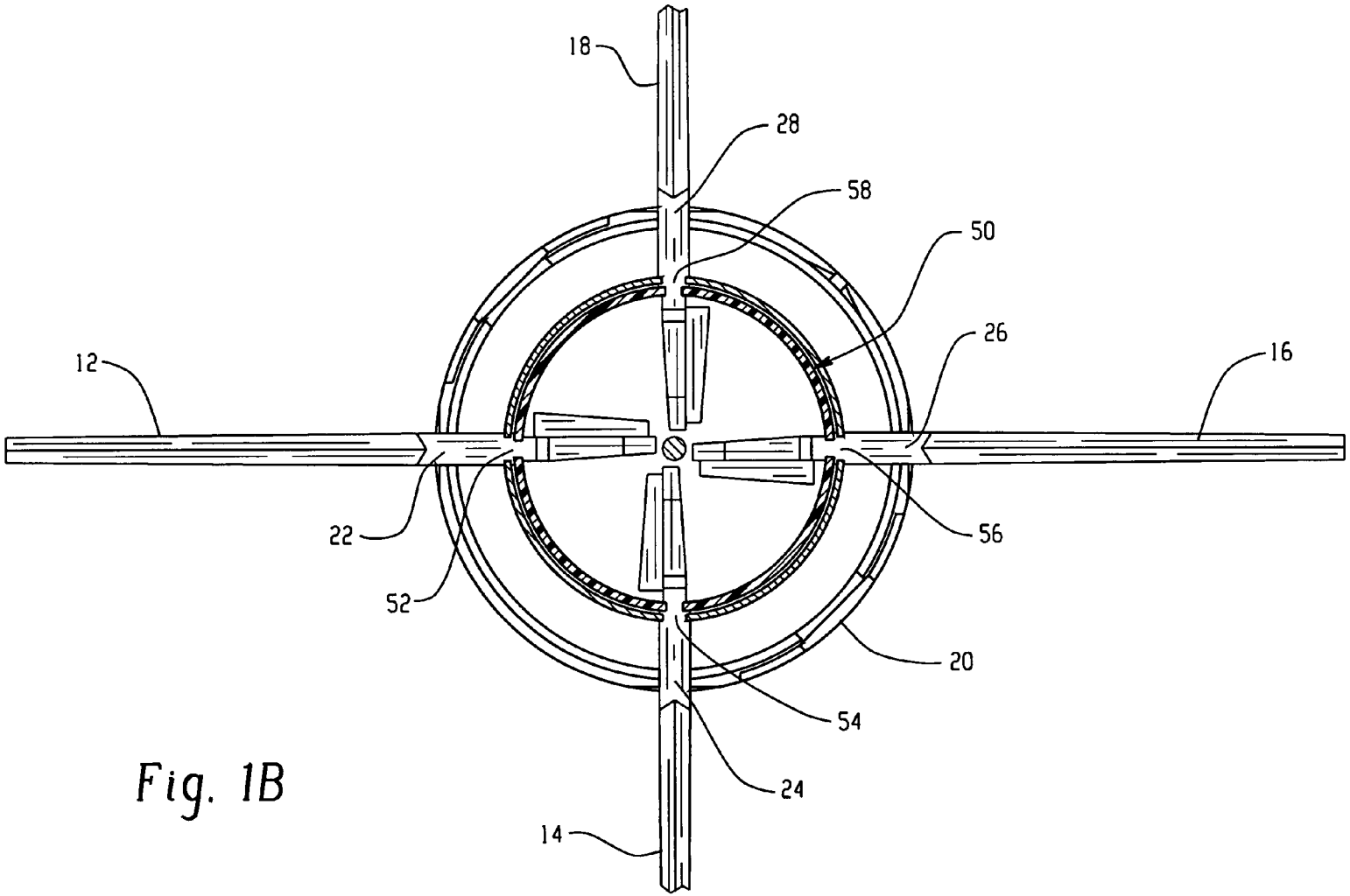

FIGS. 1A and 1B are side and sectional top views, respectively, of a control unit 10 containing a plurality of control surfaces suitable for embodying the broad principles of the present invention. The control unit 10 may be disposed in a guided air vehicle (GAV) in such a manner that the plurality of control surfaces protrude through the outer shell of the GAV when deployed in order to guide the GAV during flight as will be better understood from the description found herein below. In the exemplary embodiment depicted in FIGS. 1A and 1B, there are four control surfaces 12, 14, 16 and 18 which are shown in their deployed positions. In this embodiment, the four control surfaces are disposed about the circumference of a cylindrically shaped metal housing 20, approximately 90° apart. Each of the control surfaces 12, 14, 16 and 18 which may be made of Titanium or steel, for example, are beveled width wise at an angle away from a center line along the span thereof to render knifed leading and trailing span edges. Thus, each control surface appears sideways in the shape of an elongated diamond as shown by the side view of surface 14 in FIG. 1A. Note that the material and shape of the control surfaces 12, 14, 16 and 18 are described herein by way of example and that other materials and shapes may be used just as well without deviating from the broad principles of the present invention.

The metallic housing 20 includes vertical slotted openings 22, 24, 26 and 28 through which the control surfaces 12, 14, 16 and 18, respectively, may be folded into cavities of the housing 20 and stowed away as will become more evident from the description found herein below. In the present embodiment, the housing 20 may be made of Titanium, steel, aluminum or high performance plastics and may be partitioned into two stages—a bottom stage 30 and a top stage 32, for ease in the assembly of parts. For example, electrical actuating motors for each of the control surfaces may be seated in cavities on the top surface of the bottom stage 30 and protrude upward beyond the top surface. In addition, the bottom stage 30 contains in cut out cavities thereof drive gear trains and shafts mechanically coupling the actuator motors to their respective control surfaces. Exemplary shafts 34 and 36 are shown coupled to control surfaces 12 and 16, respectively, in FIG. 1A. An assembly of motor controller electronics and one or more power sources, such as batteries, for example, may be also disposed in cut out cavities of the bottom stage 30 and connected through wiring to power and control the actuator motors.

Once the motors, gear trains, shafts, batteries and electronic assembly are secured in place in and on the bottom stage 30, then the top stage 32 may be placed on top of the bottom stage 30 in a position which aligns the respective slotted openings of the two stages 30 and 32. The top stage 32 has cavities cut from the bottom surface thereof which match the configurations of the control surface actuator motors which protrude up from the bottom stage 30 so as to fit over and cover them. The top stage 32 sits on and around a circumferential edge seal 40 of the bottom stage 30. A long screw 42 may be disposed up through stage 30, screwed into a threaded metal hole in stage 32 and tightened to secure the two stages 30 and 32 together around the edge seal 40. An electrical connector 44 may be secured to an aperture at the bottom of the bottom stage 30 to permit electrical connections of command signals from a command processor of the GAV to couple to the motor controller electronics of the unit 10.

Disposed on top of the top stage 32 is a circular retaining cap or disk 50 which may be made of a plastic material, for example. The disk 50 includes slots 52, 54, 56 and 58 around the circumference of its side surface, approximately 90° apart. In a zero degrees (0°) position state, the disk 50 is positioned with respect to the top stage 32 so that the slots 52, 54, 56 and 58 align respectively with the slotted openings 22, 24, 26 and 28. A screw 60 secures the disk 50 to the top stage 32 and acts as a pivot point for a rotation of the disk 50. Grooves corresponding to the control surfaces 12, 14, 16 and 18 are cut into the bottom of the retaining disk 50. These groves extend radially from around the pivot point out to the slots 52, 54, 56 and 58 to accommodate the tips of the control surfaces when folded into the housing 20. Clearance is retained between the retaining disk 50 and top stage 32 circumferentially along a circular edge 62 to permit a substantially free rotation of disk 50 with respect to the top stage 32, the effects of such rotation being explained in greater detail in the description below.

In the present embodiment, the control surfaces 12, 14, 16, and 18 may be folded manually through their respective slotted openings 22, 24, 26 and 28 into the housing 20. Generally, when deployed, each of the control surfaces are locked into their deployed positions by a latch mechanism, for example. So, when it is time to rotate each control surface into the housing 20, the latch mechanism is unlatched and each control surface is rotated about an axis 70 into the housing 20 to the 0° position or ready to deploy state (see FIGS. 3A and 3B). Alternatively, the motor controller of the electronics assembly in the bottom stage 30 may be pre-programmed to operate the control surface actuator motors through a sequence of operations to fold the control surfaces into the housing 20.

In either case, the motor controller is pre-programmed to operate the actuator motors through a sequence of operations to simultaneously stow them in place from the 0° position. The motor controller is also pre-programmed to operate the actuator motors through a sequence of operations, as directed by commands from the command processor of the GAV, for example, to move the control surfaces from the stowed state to the ready to deploy state, and then, to deploy the control surfaces from the housing 20. In the present embodiment, the operations of the plurality of motor actuators are synchronized substantially. However, it is understood that this need not be the case. Generally, during testing of the unit 10, the control surfaces 12, 14, 16 and 18 are controlled through various operations. Once successful testing is completed, the control surfaces are folded up into the housing 20 and stowed away therein for storage, transportation and launch. Generally, thereafter, the control surfaces will not be deployed again until commanded to do so after launch and during flight of the GAV.

Once the control surfaces are stowed away in the housing 20, the unit 10 may be disposed within a guided air vehicle (GAV) at a position along the length thereof dependent on whether the control surfaces are to be applied as fins, wings or canards. For example, if the control surfaces are to act as fins, then the unit 10 is disposed at the rear end of the GAV in such a manner to align the slots 22, 24, 26 and 28 with corresponding slots in the skin or shell of the GAV so that when deployed the control surfaces will protrude through the skin at the rear end of the GAV and act as guiding fins thereof. Accordingly, if the control surfaces are to act as canards, then the unit 10 is disposed at the front end of the GAV in such a manner to align the slots 22, 24, 26 and 28 with corresponding slots in the skin or shell of the GAV so that when deployed the control surfaces will protrude through the skin at the front end of the GAV and act as guiding canards thereof.

Figure 2:
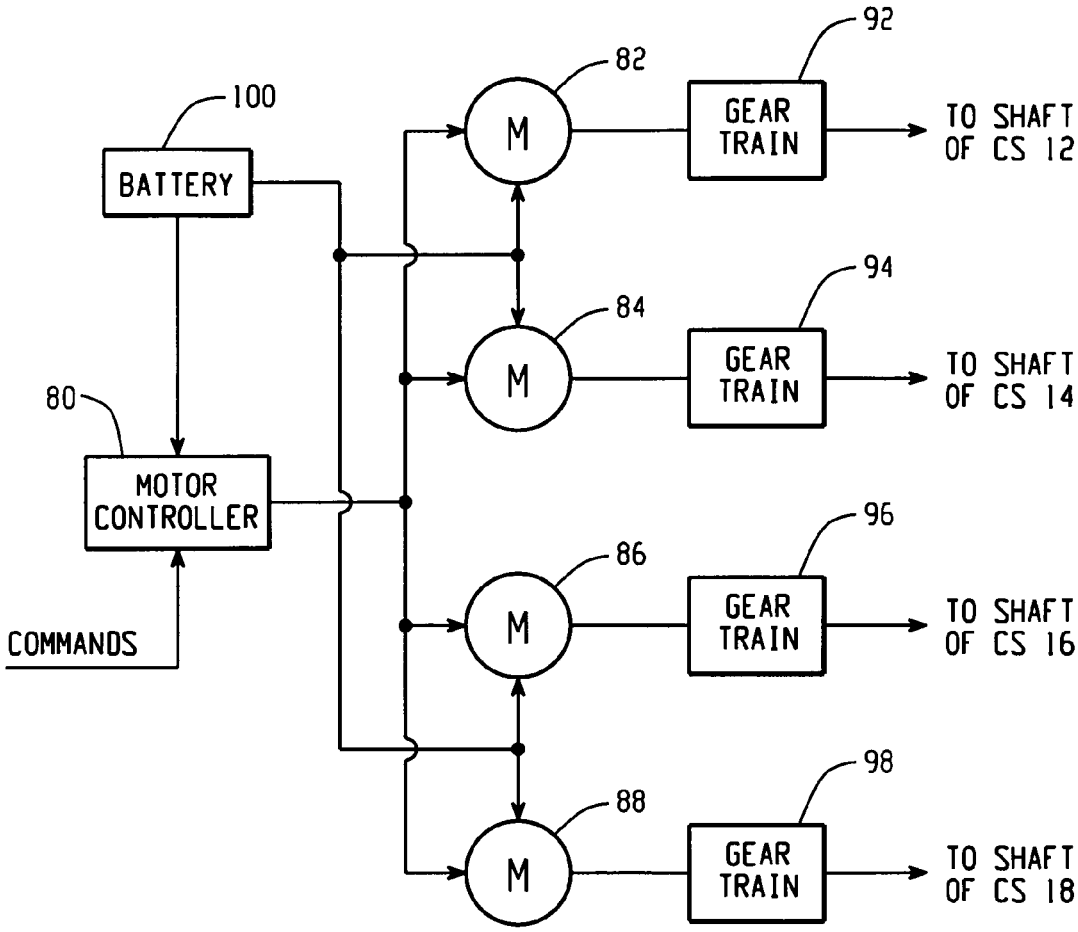
FIG. 2 is a block diagram functional schematic of an exemplary motor controller and control surface actuator motor assembly suitable for use in the embodiment of FIGS. 1A and 1B.

A block diagram functional schematic of the motor controller, control surface actuator motors and corresponding gear trains suitable for use in the embodiment of FIGS. 1A and 1B is shown in FIG. 2. Referring to FIG. 2, a common motor controller 80 is electrically coupled to actuator motors 82, 84, 86 and 88 which respectively correspond to control surfaces 12, 14, 16 and 18. Each of the motors 82, 84, 86 and 88 are mechanically coupled to its respective control surface shaft through a corresponding gear train 92, 94, 96 and 98. In the present embodiment, the motors and associated gear trains may be made intentionally inefficient to reduce movement of the control surfaces when in a static position. One or more batteries 100 may be coupled to the electrical motors 82, 84, 86 and 88 and electronic controller 80 to provide operational electric power thereto.

As noted above, when the controller 80 receives a command via connector 44, it responds by controlling the motors 82, 84, 86 and 88 through the proper sequence of operations. The motors 82, 84, 86 and 88, in turn, move the corresponding control surfaces 12, 14, 16 and 18 to their desired positions simultaneously via the respectively corresponding gear train and shaft mechanically linked thereto. For example, if the motor controller 80 is commanded to fold the control surfaces into the housing 20, it controls the motors 82, 84, 86 and 88 to rotate the control surfaces about their respective axes 70 until each control surface 12, 14, 16 and 18 passes through its corresponding slotted opening 22, 24, 26 and 28 and is contained within their respective cavities of the housing 20 as shown in the FIGS. 3A and 3B which are side and sectional top views of unit 10.

Figure 3B:
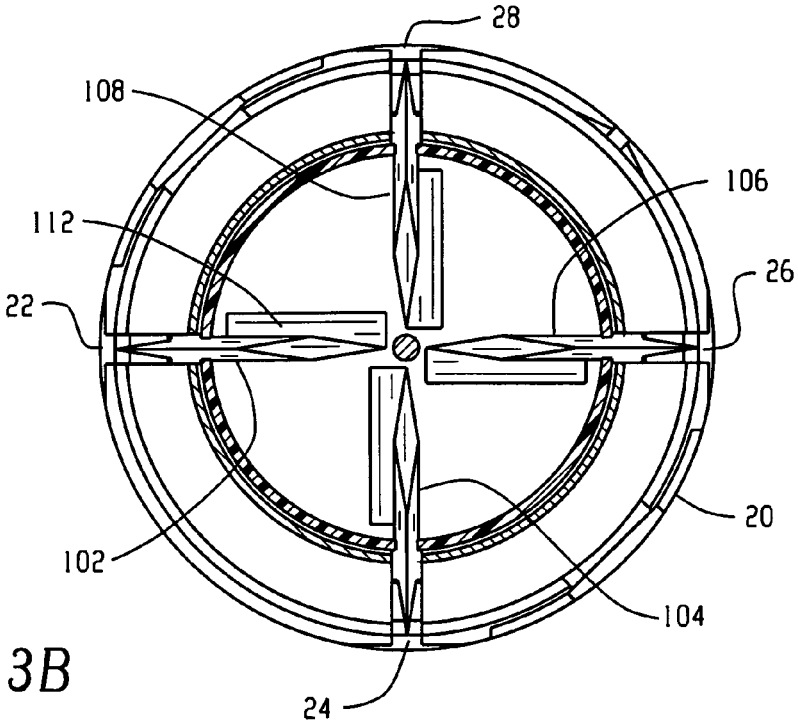
FIGS. 3A and 3B are side and sectional top views, respectively, of the control unit showing the plurality of control surfaces in a folded and ready to deploy state.
Figure 3A:
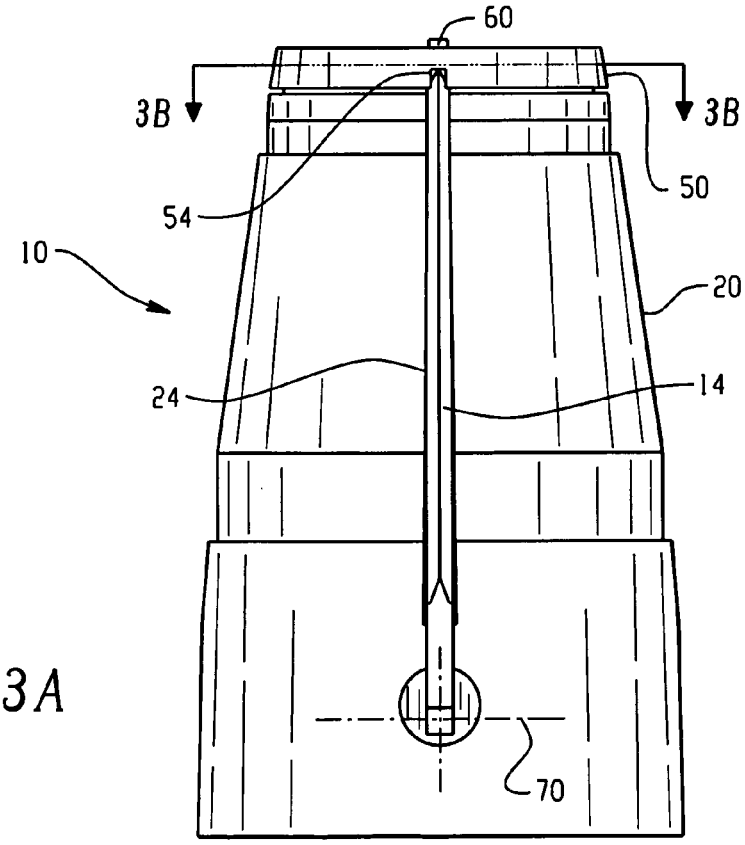

Referring to FIGS. 3A and 3B, the control surfaces 12, 14, 16 and 18 are folded respectively through slotted openings 22, 24, 26 and 28 into cavities 102, 104, 106 and 108 cut into the housing 20. During folding of the control surfaces, the retaining disk 50 is in the 0° position and the tips of the control surfaces pass through retainer slots 52, 54, 56 and 58 and into the corresponding grooves thereof. Once the step of folding the control surfaces 12, 14, 16 and 18 into their respective housing cavities 102, 104, 106 and 108 is complete, the motor controller 80 may be commanded to execute a sequence of pre-programmed operations to control the motors 82, 84, 86 and 88 to simultaneously rotate and cant the control surfaces 12, 14, 16 and 18 into a stowed position as shown in FIGS. 4A and 4B which are side and sectional top views of unit 10.

Figure 4B:
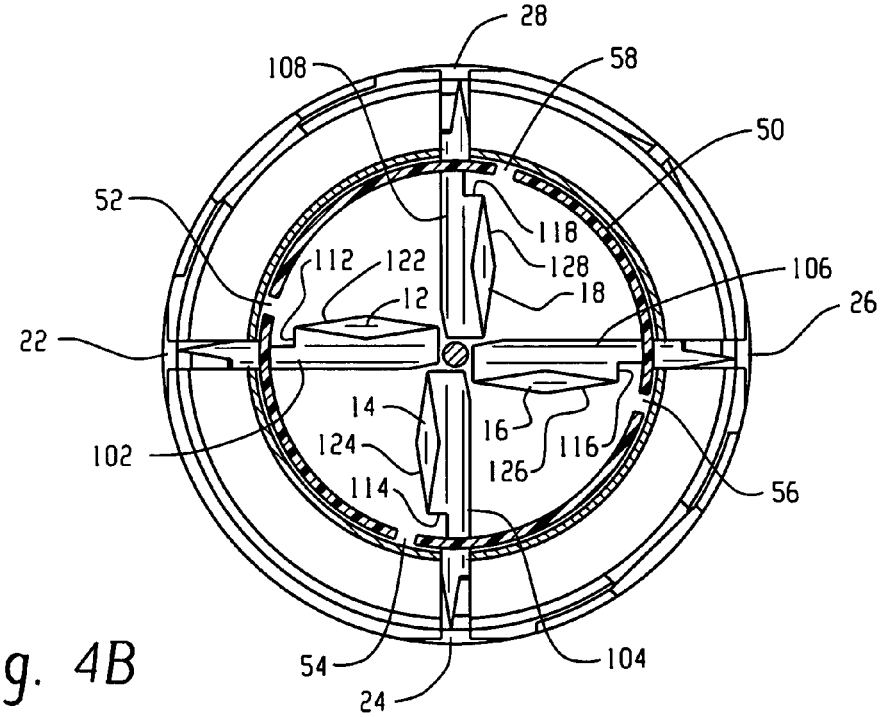
FIGS. 4A and 4B are side and sectional top views, respectively, of the control unit showing the plurality of control surfaces in a folded and stowed state.
Figure 4A:
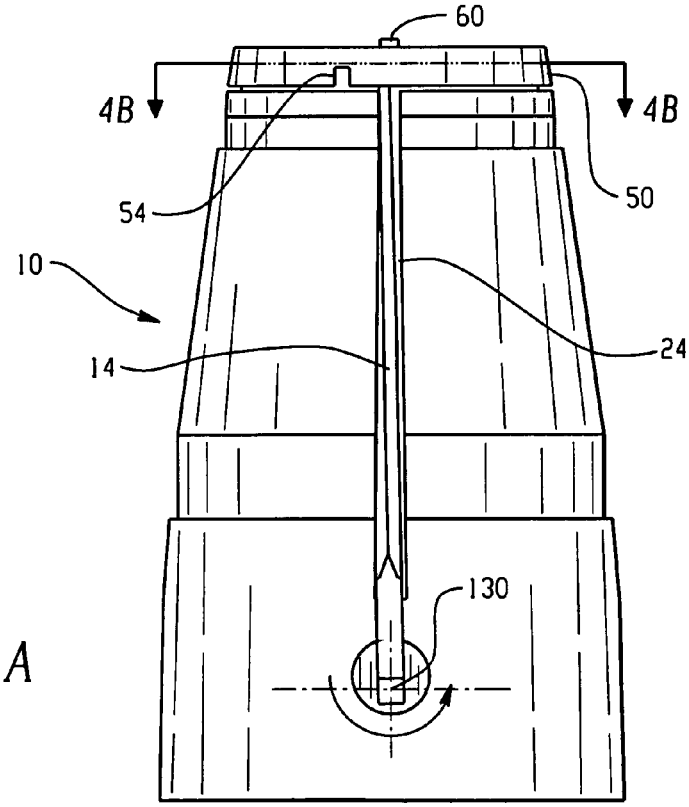
Figure 5:
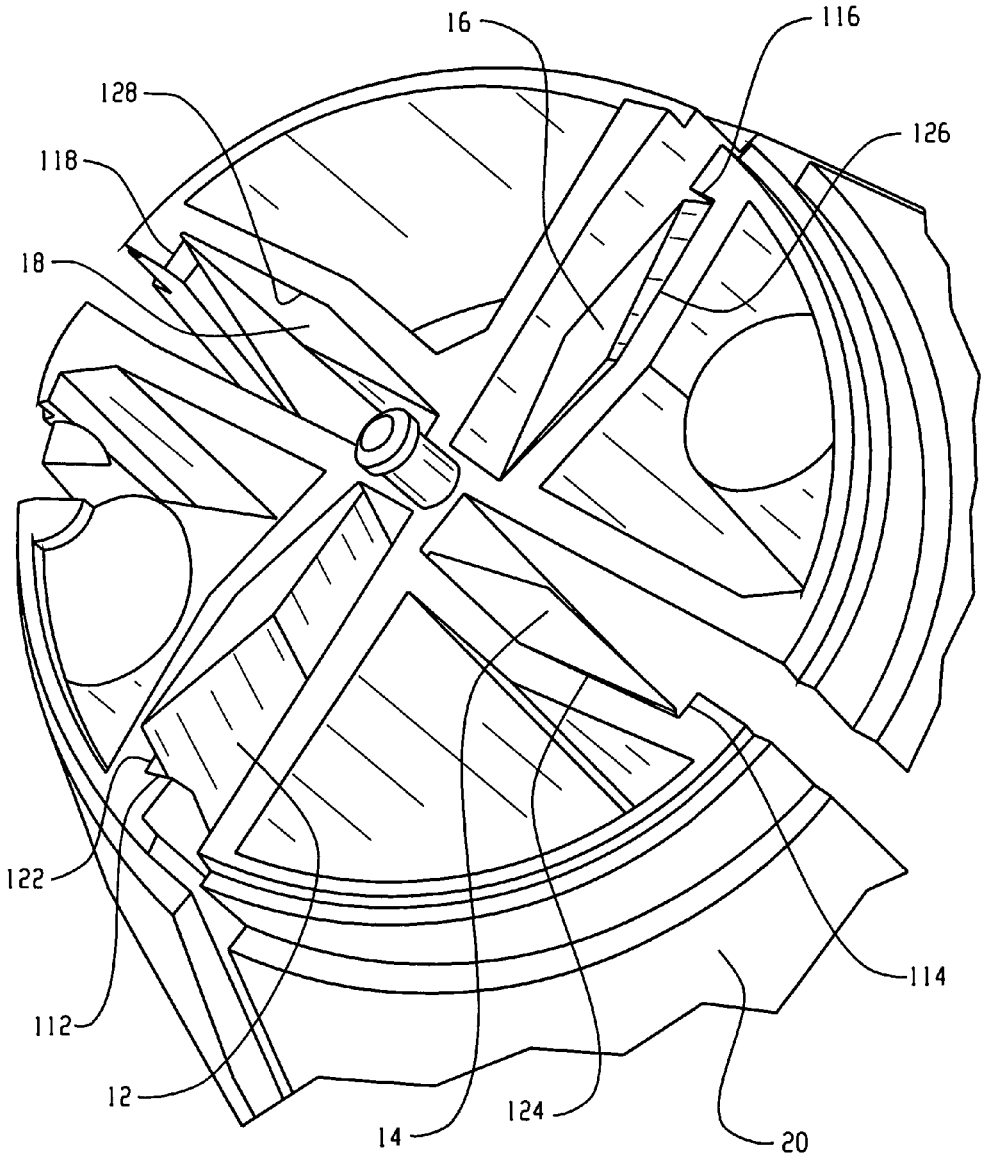
FIG. 5 is a cut away isometric illustration of a portion of the control unit showing the plurality of control surfaces in a stowed state in greater detail.

Referring to FIGS. 4A and 4B, the cavities 102, 104, 106 and 108 are cut out from the housing 20 to each include an angled ledge 112, 114, 116 and 118, respectively, and an angled side wall support surface 122, 124, 126 and 128, respectively, to accommodate stowage of the respectively corresponding control surfaces 12, 14, 16 and 18. FIG. 5 is a cut-away illustration of the housing 20 showing the stowed control surfaces 12, 14, 16 and 18 in their cavities 102, 104, 106 and 108 resting behind their respective angled ledges 112, 114, 116 and 118 and along their angled side wall support surfaces 122, 124, 126 and 128. In the present embodiment, the control surfaces 12, 14, 16 and 18 are controlled simultaneously to their stowed positions by rotating their respective shafts counterclockwise approximately 2.5°, for example, from the 0° position around an axis 130 perpendicular to the page as shown in FIG. 4A.

The rotational motion of a control surface about axis 130 to and from a stowed position is achieved in the present embodiment by a pinion gear, which is part of the corresponding actuator motor, driving a spur gear that is part of a ball screw or lead screw. A nut of the ball screw or lead screw has a link attached to it via a pin configuration. An opposite end of the link is attached to an arm using the pin configuration. The arm is integral to an output shaft to which the control surface is assembled using a pin that permits the control surface to pivot about axis 70 from the ready to deploy position (see FIGS. 3A and 3B) to the deployed position (see FIGS. 1A and 1B).

Note that as the control surfaces are simultaneously rotated about their respective axes 130 to their canted or stowed positions behind their respective angled ledges and against their respective angled sidewall supports, the tips of the control surfaces which are disposed into grooves of the retaining disk 50 cause the retaining disk 50 along with the slots 52, 54, 56 and 58 to rotate along with them. Accordingly, when in the control surfaces 12, 14, 16 and 18 are in their stowed positions, the corresponding slots 52, 54, 56 and 58 are offset from their 0° position and no longer aligned with their corresponding slotted openings 22, 24, 26 and 28 as shown in FIGS. 4A and 4B. The combination of the offset slots 52, 54, 56 and 58, the angled ledges 112, 114, 116 and 118 and the angled supporting sidewalls 122, 124, 126 and 128 prevent the control surfaces 12, 14, 16 and 18 from being unintentionally forced out from the housing 20 as will become better understood from the following description.

During the control surface stowage and launch, the control surfaces are folded within the structure 10 and are canted or stowed over to their respective control surface side-wall supports. In this stowed position, the control surfaces are located behind their respective angled ledges. Upon launch of the GAV, forces act on the control surfaces to force them against their respective control-surface side-wall supports. If the launch produces a GAV spin, the spin acts to force the control surfaces against their respective control-surface side-wall supports, and in addition, acts to force the trailing edge of the control surface against their respective angled ledges caused by a radial centripetal force. The angled ledges prevent the control surfaces from backdriving or rotating toward their respective control surface slotted opening.

Figure 6B:
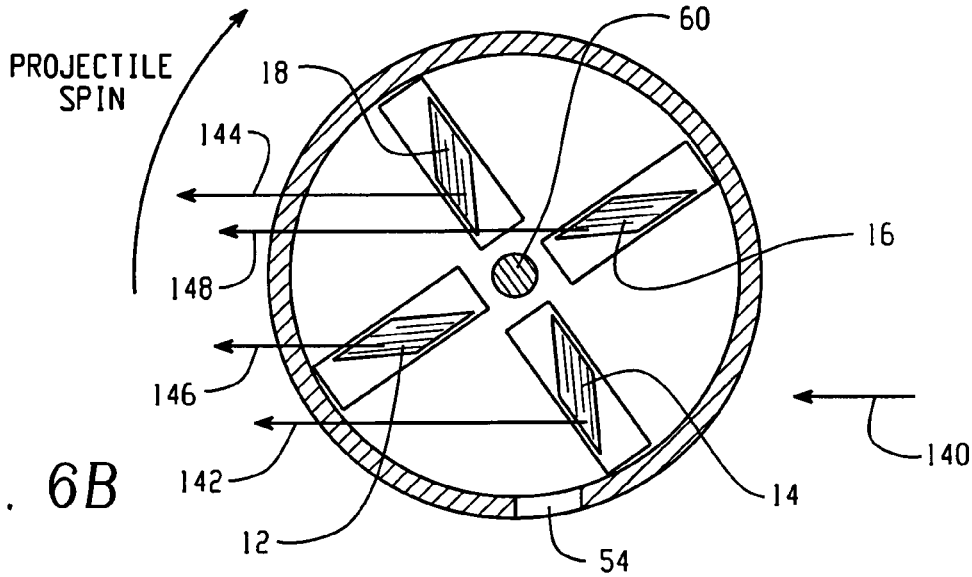
FIGS. 6A and 6B are side and top view illustrations of the control unit showing forces exerted thereon during launch and flight.
Figure 6A:
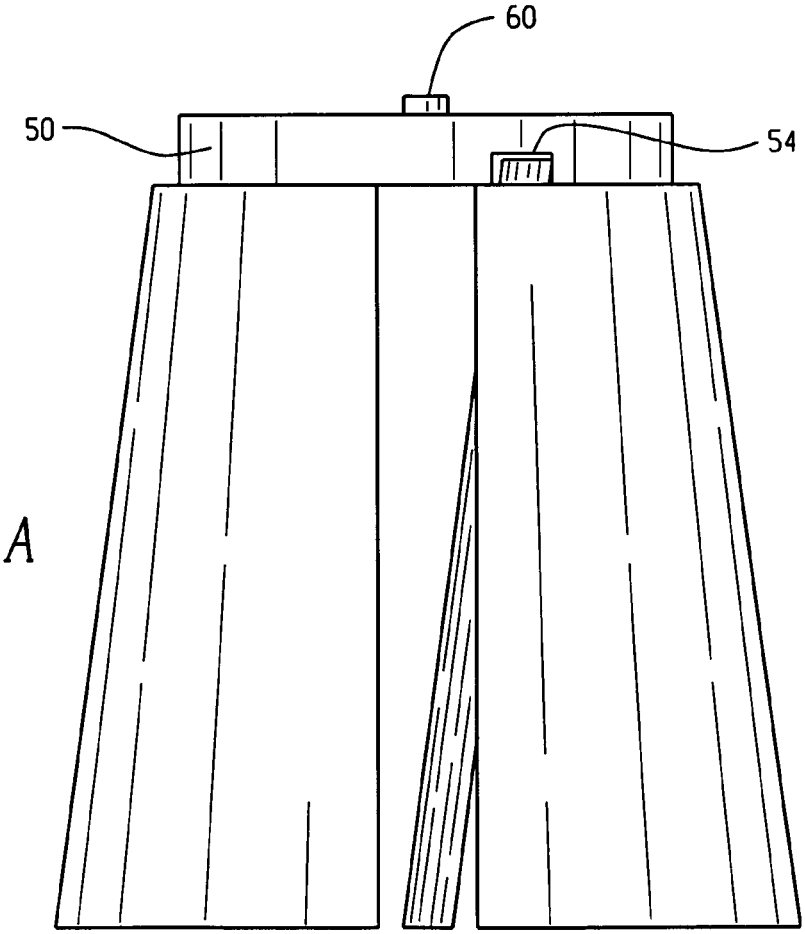

In high-g applications of a GAV such as a cannon or gun launch, special considerations have to be given to the balloting (side-slap) and set-back (primary launch thrust) forces exerted on the control surfaces of unit 10. The forces developed during high-g acceleration are such that prior anti-backdrive features may be overcome, possibly resulting in a premature deployment. As shown in the illustration of the present embodiment in FIGS. 6A and 6B, when a balloting force or load is present, a force shown by the arrowed line 142 acting on the control surface 14, for example, is reacted by an equal force shown by the arrowed line 144 acting on the diametrically opposed control surface 18 resulting in a zero rotational force. The same action occurs for control surfaces 12 and 16 as shown by force arrowed lines 146 and 148, respectively. Under such conditions in the present embodiment, the control surfaces 12, 14, 16 and 18 will not backdrive and will not cause premature deployment.

Also, during set-back force conditions, the control surfaces (which are canted over to the control surface side-wall support) are forced onto their respective side-wall supports. Thus, the side-wall supports absorb some of the set-back load into the housing structure 20. In addition, the control surface retainer disk 50 is forced downwards onto the control surfaces which aids to prevent control surface rotation toward the slot. During set-forward or muzzle exit conditions, a force is exerted on the control surfaces which tries to move the control surfaces off the side-wall support toward the zero degrees or deployment position. In the present embodiment, control surface rotation is limited by a balanced actuation output, inefficiency in the drive mechanism, gear ratio (higher is better), anti-backdrive features of the cavity and slot wall, some resolved force into the control surface retainer disk and short set-forward time duration in which the control surface has too much inertia to move significantly.

Once the GAV is launched and in flight, the motor controller of the unit 10 is operative to receive a deployment command via connector 44. Upon receipt of the control surface deployment command, the control surface motor actuators are controlled by the motor controller 80 to move their respective control surfaces from their stowed positions (see FIGS. 4A and 4B) to the zero degrees or ready for deployment positions (see FIGS. 3A and 3B). During the movement from the stowed to zero degree positions, the control surfaces are forced against their respective angled ledges due to the radial centripetal forces exerted thereon. Thus, the control surfaces tend to resist movement while in their stowed positions due to friction imposed by their respective ledges. In the present embodiment, the respective motor actuators are designed to be capable of overcoming control surface frictional forces caused by the control surface rubbing against its respective angled ledge. The actuator motors are also designed to be capable of overcoming the force exerted by the sloping feature of the angled ledge.

As each control surface moves towards its zero degree position in the same rotational sense as described herein above, the control surface retainer disk 50 rotates about its pivot point 60 in the direction of the control surface movement. Accordingly, once the control surfaces are at their respective zero degree positions, they are aligned in their respective slotted openings and are free to be deployed. When the control surfaces are in the ready to be deployed position (see FIGS. 3A and 3B), the motor controller 80 is operational to control the actuator motors to cause a simultaneous rotation of the control surfaces 12, 14, 16 and 18 about their respective axis 70 until the control surfaces are in their deployed positions (see FIGS. 1A and 1B). As noted above, during deployment, the control surfaces 12, 14, 16 and 18 are aligned with and pass through openings in the outer shell of the GAV so that when deployed, the control surfaces protrude out from the shell in the air stream of the GAV to guide the flight thereof.

It is understood that for standard ground, ship, underwater or air launched applications of a GAV, the slotted control surface retainer disk 50 may not be needed. However, for certain environment conditions, such as extreme vibration, high shock or very high acceleration such as in a gun launch application of a GAV, the slotted control surface retainer disk 50 is desirable to prevent the control surface backdriving of the actuator motor during set-back and balloting conditions.

In spin applications of the GAV, the centrifugal force exerted radially on the control surfaces by the spin of the GAV will cause the control surfaces to be forced away from the housing 20 as they become aligned with their respective slotted openings. Thus, the deployment movement may be initiated by these radial centrifugal forces. However, in those GAV applications in which no spin of the GAV is anticipated, some additional apparatus may be desirable to momentarily force the control surfaces away from their static ready for deployment positions (see FIGS. 3A and 3B) to start the deployment movement thereof. In these instances, a spring like member, like a torsional spring, for example, may be disposed at the pivot pin of each control surface or in each control surface cavity to momentarily apply a force radially outward on the corresponding control surface as it is aligned with its slotted opening of the housing 20. It is understood that in this embodiment, each actuator motor and associated gear train will have to be designed to be capable of compressing the corresponding spring like member when folding the corresponding control surface into its cavity.

While the present invention has been described herein above in connection with one or more embodiments, it is understood that this was done by way of example with no intention of limiting the present invention in any way. Accordingly, the present invention should not be limited by the foregoing described embodiments, but rather, construed in breadth and broad scope in accordance with the recitation of the claims appended hereto.

What is claimed is:

1. Apparatus for stowing and deploying a plurality of control surfaces of a guided air vehicle, said apparatus comprising:

a housing including: a plurality of slotted openings along an outside surface thereof; and a corresponding plurality of cavities within said housing, each cavity extending to the outside surface of said housing through said slotted opening corresponding thereto and configured to accommodate span wise stowage of a corresponding control surface of the plurality, each cavity having a section including an angled ledge and side wall support surface to accommodate stowage of the corresponding control surface in a span wise canted position with respect to the corresponding slotted opening.

2. The apparatus of claim 1 wherein each slotted opening extends along the outside surface of the housing to accommodate edge wise passage of the span of the corresponding control surface; and wherein each control surface is capable of being passed edge wise through the corresponding slotted opening to be folded into and deployed from the corresponding cavity of the housing.

3. The apparatus of claim 2 wherein each control surface folded into the corresponding cavity of the housing is capable of being stowed into the corresponding cavity section by canting the span of the control surface along the side wall support surface and resting a span edge of the control surface along the angled ledge.

4. The apparatus of claim 3 including a retaining cap rotatably coupled to a top of the housing, said retaining cap including a plurality of slots cut out from sides thereof, said retaining cap being rotatable to align said slots with corresponding slotted openings of the housing in first position to accommodate passage of tips of the control surfaces into corresponding cavities during folding and deploying thereof, and rotatable to offset said slots from corresponding slotted openings of the housing in a second position to prevent passage of the control surfaces from corresponding cavities during stowage thereof.

5. The apparatus of claim 4 wherein the housing is shaped substantially as a cylinder; wherein the slotted openings are substantially vertical to and spaced circumferentially about the surface of the cylindrical housing; and wherein the cavities corresponding to the slotted openings extend radially inward from the corresponding vertical slotted openings toward a cylindrical center.

6. The apparatus of claim 5 including four control surfaces spaced substantially 90° apart circumferentially about the surface of the cylindrical housing.

7. The apparatus of claim 5 wherein the retaining cap is substantially disk shaped and rotatably mounted to the cylindrical housing at a pivot point at a cylindrical center.

8. The apparatus of claim 4 wherein each control surface includes a span base, a span tip, a span trailing edge and a span leading edge; wherein the span base of each control surface is rotatably coupled through a base of the corresponding slotted opening to the housing.

9. The apparatus of claim 8 wherein each control surface is capable of being rotated edge wise through the corresponding slotted opening by the rotatable coupling.

10. The apparatus of claim 8 wherein each control surface folded into the corresponding cavity of the housing is capable of being rotated into the corresponding cavity section by the rotatable coupling.

11. Method of stowing and deploying a plurality of control surfaces of a guided air vehicle, said method comprising the steps of:

folding each control surface of said plurality edge wise through a corresponding slotted opening disposed along an outside surface of a housing and into a corresponding cavity within said housing;

moving each folded control surface into a stowage section of the corresponding cavity by canting a span of each control surface along a side wall support surface of said corresponding stowage section and resting a span edge of each control surface along an angled ledge of the corresponding stowage section to edge wise mis-align each folded control surface from the corresponding slotted opening;

moving each control surface in the corresponding cavity from the corresponding stowage section into edge wise alignment with the corresponding slotted opening; and deploying each control surface edge wise aligned with the corresponding slotted opening from the cavity through the corresponding slotted opening to a deployed position.

12. The method of claim 11 including the step of rotating each folded control surface into the stowage section of the corresponding cavity by canting a span of each control surface along a side wall support surface of the corresponding stowage section and resting a span edge of each control surface along an angled ledge of the corresponding stowage section.

13. The method of claim 11 including the step of rotating each control surface in the corresponding cavity from the corresponding stowage section into edge wise alignment with the corresponding slotted opening.

14. The method of claim 11 including the steps of: rotatably coupling a slotted retaining cap to a top of the housing; rotating the retaining cap to a first position to align the slots of the retaining cap with corresponding slotted openings of the housing to accommodate passage of tips of the control surfaces into corresponding cavities during the steps of folding and deploying thereof; and rotating the retaining cap to a second position to offset the slots of the retaining cap from corresponding slotted openings of the housing to prevent passage of the control surfaces from corresponding cavities during stowage thereof.

15. The method of claim 14 wherein the rotation of the retaining cap is driven by the movement of the control surfaces.

16. The method of claim 11 wherein the plurality of control surfaces are deployed simultaneously from their corresponding cavities of the housing to their deployed positions.

17. The method of claim 11 wherein the plurality of folded control surfaces are moved simultaneously into their corresponding stowage cavity sections of the housing.

18. The method of claim 11 wherein the plurality of control surfaces are moved simultaneously in their corresponding cavities from their corresponding stowage sections into edge wise alignment with their corresponding slotted openings.

19. The method of claim 11 including the steps of: rotatably coupling a span base of each control surface through a base of the corresponding slotted opening to the housing; and rotating each control surface edge wise through the corresponding slotted opening by the rotatable coupling.

20. The method of claim 11 including the steps of: rotatably coupling a span base of each control surface through a base of the corresponding slotted opening to the housing; and rotating each folded control surface to and from the corresponding stowage section by the rotatable coupling.

* * * * *